US009885999B2

(12) United States Patent
Uohashi

(10) Patent No.: US 9,885,999 B2
(45) Date of Patent: Feb. 6, 2018

(54) IMAGE FORMING APPARATUS INCLUDING DETECTING DEVICE DETECTING OPENING/CLOSING STATE OF COVER

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/385,234

(22) Filed: Dec. 20, 2016

(65) Prior Publication Data

US 2017/0185029 A1 Jun. 29, 2017

(30) Foreign Application Priority Data

Dec. 25, 2015 (JP) ..... 2015-254306

(51) Int. Cl.

| | |
|---|---|
| ***G03G 21/00*** | (2006.01) |
| ***H01H 9/00*** | (2006.01) |
| ***G03G 21/16*** | (2006.01) |
| ***H01H 21/06*** | (2006.01) |
| ***H01H 9/22*** | (2006.01) |

(52) U.S. Cl.

CPC ..... *G03G 21/1633* (2013.01); *H01H 9/22* (2013.01); *H01H 21/06* (2013.01)

(58) Field of Classification Search

CPC ..... G03G 15/5004; G03G 21/1633; G03G 2221/169; H01H 9/22; H01H 21/06

USPC ..... 399/88, 124; 200/50.12

See application file for complete search history.

(56) References Cited

U.S. PATENT DOCUMENTS

| | | | | |
|---|---|---|---|---|
| 7,860,431 | B2 * | 12/2010 | Kitamura | B41J 29/13 399/107 |
| 8,084,702 | B2 * | 12/2011 | Kawarago | G03G 15/5004 200/50.1 |
| 2011/0056811 | A1 * | 3/2011 | Takenaka | H01H 9/22 200/50.02 |
| 2012/0012445 | A1 * | 1/2012 | Ohta | G03G 21/1633 200/50.12 |
| 2014/0072333 | A1 * | 3/2014 | Yamashita | G03G 21/1623 399/110 |

FOREIGN PATENT DOCUMENTS

| | | | |
|---|---|---|---|
| JP | 08-285183 | A | 11/1996 |
| JP | 10-162684 | A | 6/1998 |
| JP | 2006328892 | A * | 12/2006 |
| JP | 2011-017835 | A | 1/2011 |

* cited by examiner

*Primary Examiner* — Robert Beatty

(74) *Attorney, Agent, or Firm* — Studebaker & Brackett PC

(57) ABSTRACT

An image forming apparatus includes a cover member, an opening/closing detecting device and an elastic member. The cover member is supported so as to open and close an opening formed in an apparatus main body. The opening/closing detecting device is configured to be switched into OFF state to detect that the cover member is in opening state where the opening is opened and into ON state to detect that the cover member is in closing state where the opening is closed. The elastic member is interposed between the opening/closing detecting device and the cover member. The elastic member is configured to be deformed when the cover member closes the opening and then to switch the opening/closing detecting device from the OFF state into the ON state.

6 Claims, 8 Drawing Sheets

IMAGE FORMING APPARATUS INCLUDING DETECTING DEVICE DETECTING OPENING/CLOSING STATE OF COVER

INCORPORATION BY REFERENCE

This application is based on and claims the benefit of priority from Japanese Patent application No. 2015-254306 filed on Dec. 25, 2015, the entire contents of which are incorporated herein by reference.

BACKGROUND

The present disclosure relates to an image forming apparatus which includes an opening/closing detecting device which detects an opening/closing state of a cover member.

An image forming apparatus is configured such that a toner container storage part or a sheet conveying part can be opened and closed by a cover member in order to replace the toner container or to remove a jammed sheet. When the cover member is opened, a user may touch a rotating body, such as a gear or a motor, or an electrical conductive member to supply electrical power to a driving member and an image forming unit may be exposed. Then, the image forming apparatus is generally provided with an interlock switch which interrupts the power supply when the cover member is opened.

The interlock switch is generally activated by the opening and closing of the cover member. In some cases, a link member is interposed between the interlock switch and the cover member.

However, because the cover member has a large size and also a large variation in dimension precision and assembling precision, the interlock switch may not be accurately activated by the opening and closing of the cover member. In addition, if a distance between the closed cover member and the interlock switch is smaller than a predetermined distance, the cover member is excessively pressed toward the interlock switch and then the interlock switch may be damaged by the cover member.

Furthermore, when the link member is interposed, it is necessary to prepare a dedicated link member. This may increase cost. In addition, in order to absorb the variation in dimension precision and assembling precision of the cover member, the interlock switch may be provided so as to be movable. However, in this case, since it is difficult to hold the interlock switch stably and also it is necessary to lengthen a wire connected to the interlock switch, a structure may be complicated and an erroneous detecting may easily occur.

SUMMARY

In accordance with an embodiment of the present disclosure, an image forming apparatus includes a cover member, an opening/closing detecting device and an elastic member. The cover member is supported so as to open and close an opening formed in an apparatus main body. The opening/closing detecting device is configured to be switched into OFF state to detect that the cover member is in opening state where the opening is opened and into ON state to detect that the cover member is in closing state where the opening is closed. The elastic member is interposed between the opening/closing detecting device and the cover member. The elastic member is configured to be deformed when the cover member closes the opening and then to switch the opening/closing detecting device from the OFF state into the ON state.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
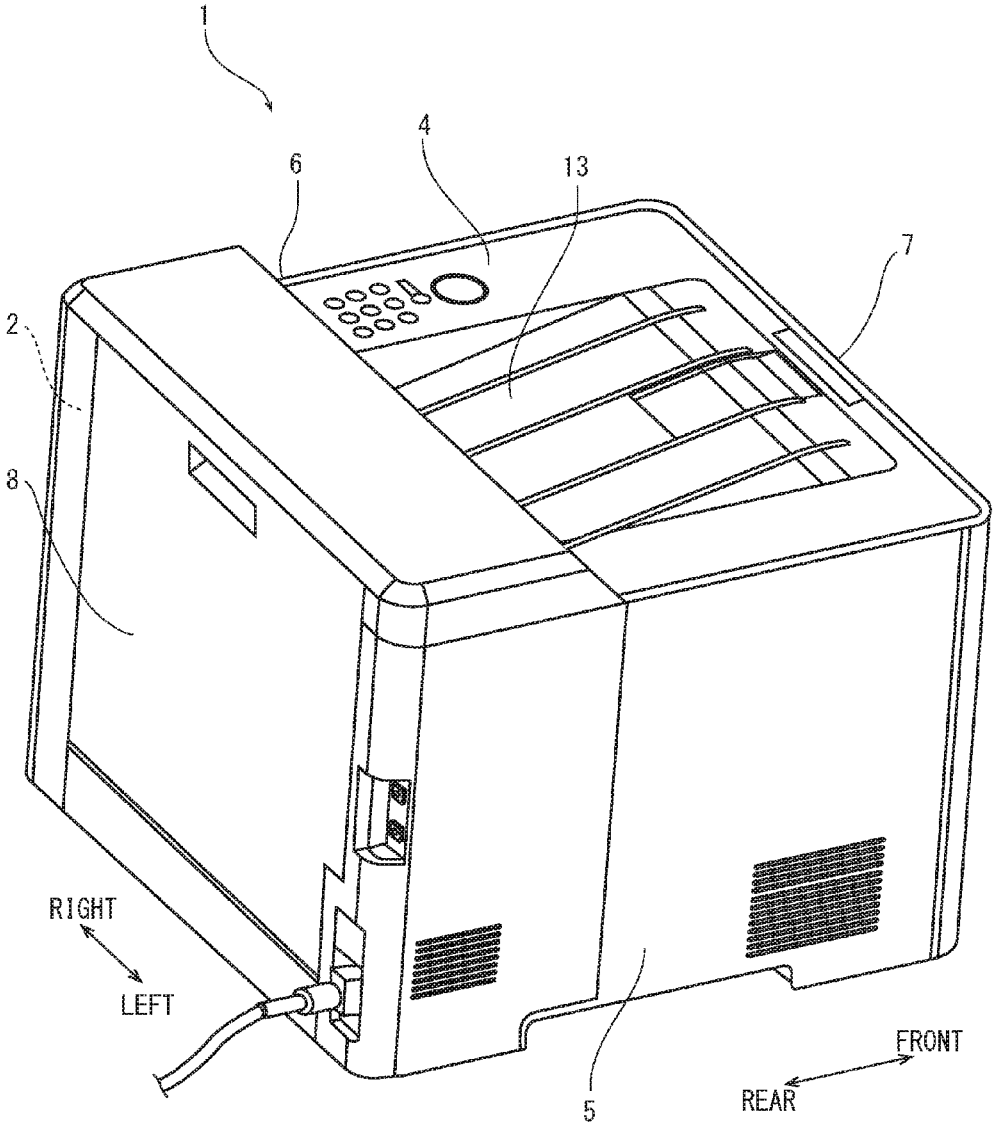
FIG. 1 is a perspective view showing a color printer, viewed from a rear side, according to one embodiment of the present disclosure.
Figure 2:
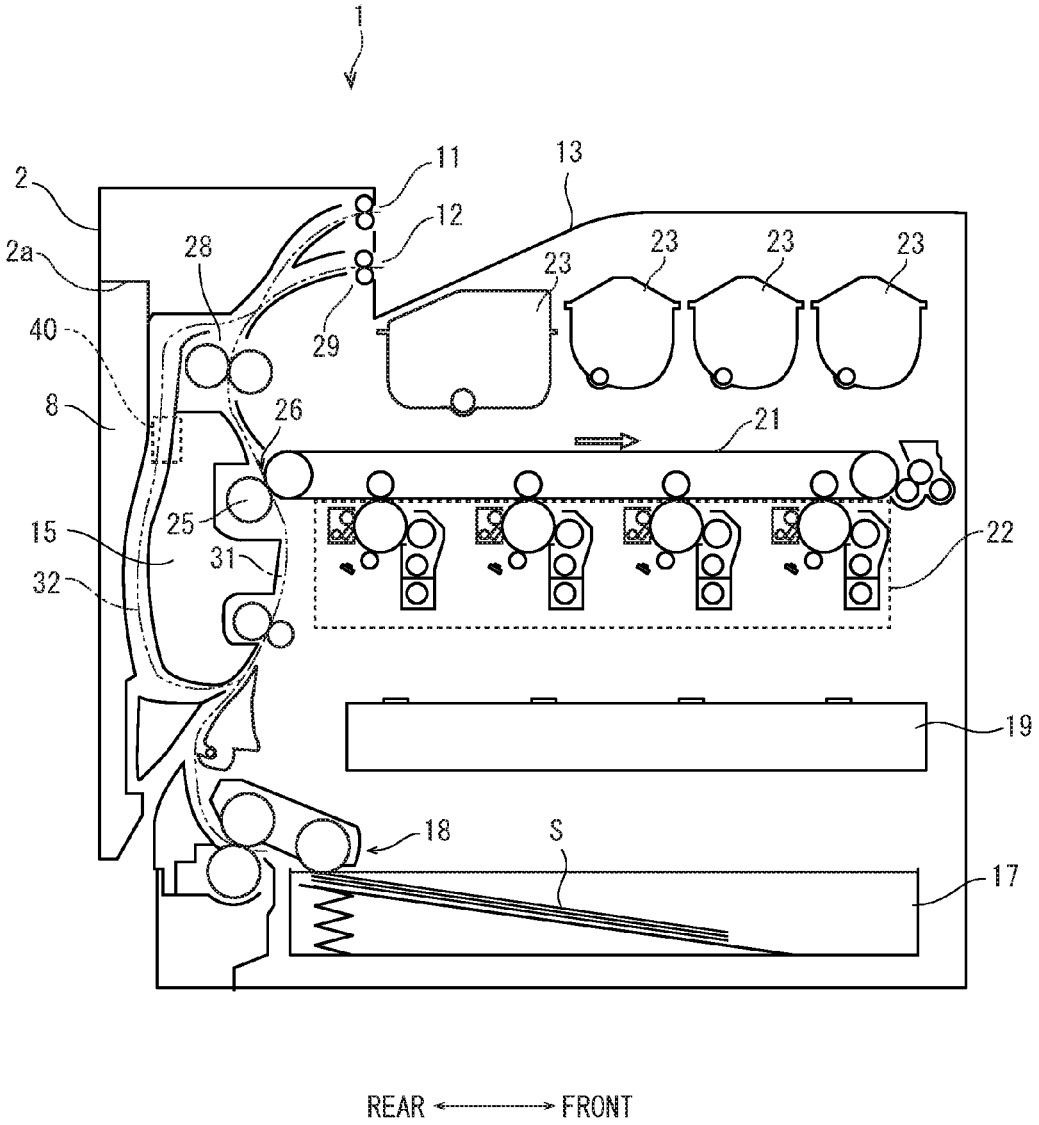
FIG. 2 is a side view schematically showing an entire structure of the color printer according to one embodiment of the present disclosure.

First, an entire structure of a color printer as the image forming apparatus will be described with reference to FIG. 1 and FIG. 2. FIG. 1 is a perspective view showing the color printer viewed from a rear side and FIG. 2 is a view schematically showing an internal structure of the color printer. In the following description, front and rear directions shown in FIG. 1 indicate front and rear directions of the color printer 1 and left and right directions are based on a direction in which the color printer 1 is viewed from the front side.

A color printer 1 includes an apparatus main body 2 in a rectangular parallelepiped shape. An upper face, a left side face, a right side face, a front face and a rear face of the apparatus main body 2 are respectively covered with an upper cover 4, a left side cover 5, a right side cover 6, a front cover 7 and a rear cover 8. As shown in FIG. 2, the upper cover 4 is formed with a switchback part 11 and a sheet ejecting port 12 which are arranged in the vertical direction. The upper cover 4 is also formed with an ejected sheet tray 13 below the sheet ejecting port 12. The rear cover 8 that is a cover member is supported to an opening 2*a* formed on the rear face of the apparatus main body 2 so as to be rotatable around its lower end to open or close the opening 2*a*. Inside the opening 2*a*, a conveying unit 15 is supported so as to be rotatable around its lower end.

In a lower part of an inside of the apparatus main body 2, a sheet feeding cassette 17 in which sheets S are stored and a sheet feeding device 18 which feeds the sheet S from the sheet feeding cassette 17 are provided. Above the sheet feeding cassette 17, an exposure device 19 is provided. Above the exposure device 19, an intermediate transferring belt 21 and an image forming unit 22 are provided. The intermediate transferring belt 21 is supported so as to circulate. The image forming unit 22 forms a toner image on the intermediate transferring belt 21 in an electrographic manner by using toner of four colors. To the image forming unit 22, toner containers 23 containing toner of each color are connected.

On the rear side of the intermediate transferring belt 21, a second transferring roller 25 is rotatably supported by the conveying unit 15. Between the intermediate transferring belt 21 and the second transferring roller 25, a second transferring part 26 is formed. Above the second transferring part 26, a fixing device 28 is provided, and above the fixing device 28, a sheet ejecting device 29 is provided so as to face the sheet ejecting port 12.

In the inside of the apparatus main body 2, a main conveying path 31 and a duplex printing path 32 for the sheet S are formed. The main conveying path 31 is formed from the sheet feeding device 18 toward the sheet ejecting device 29 through the second transferring part 26 and the fixing device 28 along in inner face of the conveying unit 15. The duplex printing path 32 is branched from the main conveying path 31 at a downstream side portion from the fixing device 28 in the conveying direction into the switch-back part 11 and then joined to the main conveying path 31 at a downstream side portion from the sheet feeding device 18 along a space between the conveying unit 15 and the rear cover 8.

Next, the operation of forming an image by the color printer 1 having such a configuration will be described. When the exposure device 19 exposes the image forming unit 22 based on an image date, the image forming unit 22 forms a toner image on the intermediate transferring belt 21. On the other hand, the sheet S fed from the sheet feeding cassette 17 by the sheet feeding device 18 is conveyed along the main conveying path 31 into the second transferring part 26 in a suitable timing with the above image forming operation. At the second transferring part 26, the toner image on the intermediate transferring belt 21 is second-transferred on the sheet. The sheet on which the toner image is transferred is conveyed on a downstream side along the main conveying path 31 to the fixing device 28. Then, the toner image is fixed on the sheet S in the fixing device 28. The sheet S with the fixed toner image is ejected from the sheet ejecting device 29 to the ejected sheet tray 13.

In the duplex printing, the sheet S with the image formed on one side is conveyed from the main conveying path 31 into the duplex printing path 32, then along the duplex printing path 32 and then along the main conveying path 31 again to form an image on the other side in the same way.

When the sheet S jammed on the duplex printing path 32 is removed, the rear cover 8 is turned around its lower end to open the duplex printing path 32. On the duplex printing path 32, conveying rollers and the others (not shown) are provided. When the duplex printing path 32 is thus opened, conductive members (not shown) which supply power to the conveying rollers and the others may be exposed. Then, the apparatus main body 2 is provided with an interlock switch 40 as an opening/closing detecting device that detects an opening/closing state of the rear cover 8 and interrupts the power supply to the conductive members when the rear cover 8 is in the opening state.

Figure 3:
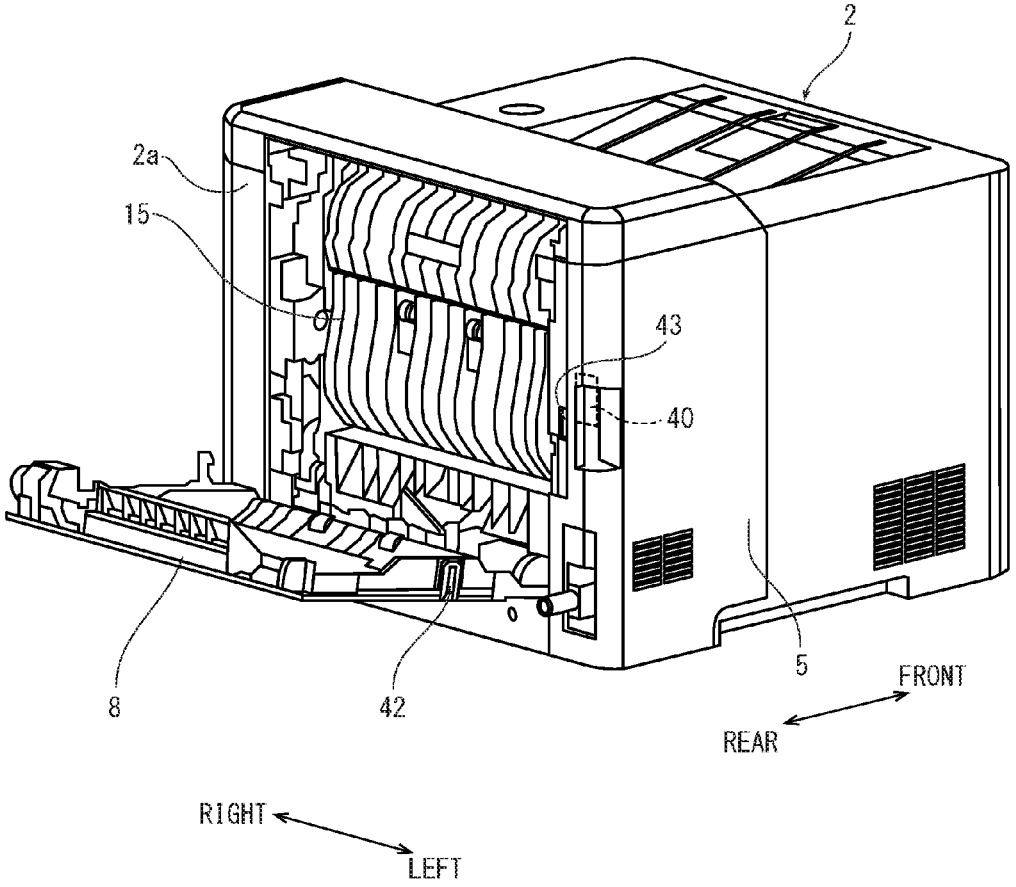
FIG. 3 is a perspective view showing an apparatus main body with a rear cover opened, viewed from the rear side, in the color printer according to one embodiment of the present disclosure.
Figure 4:
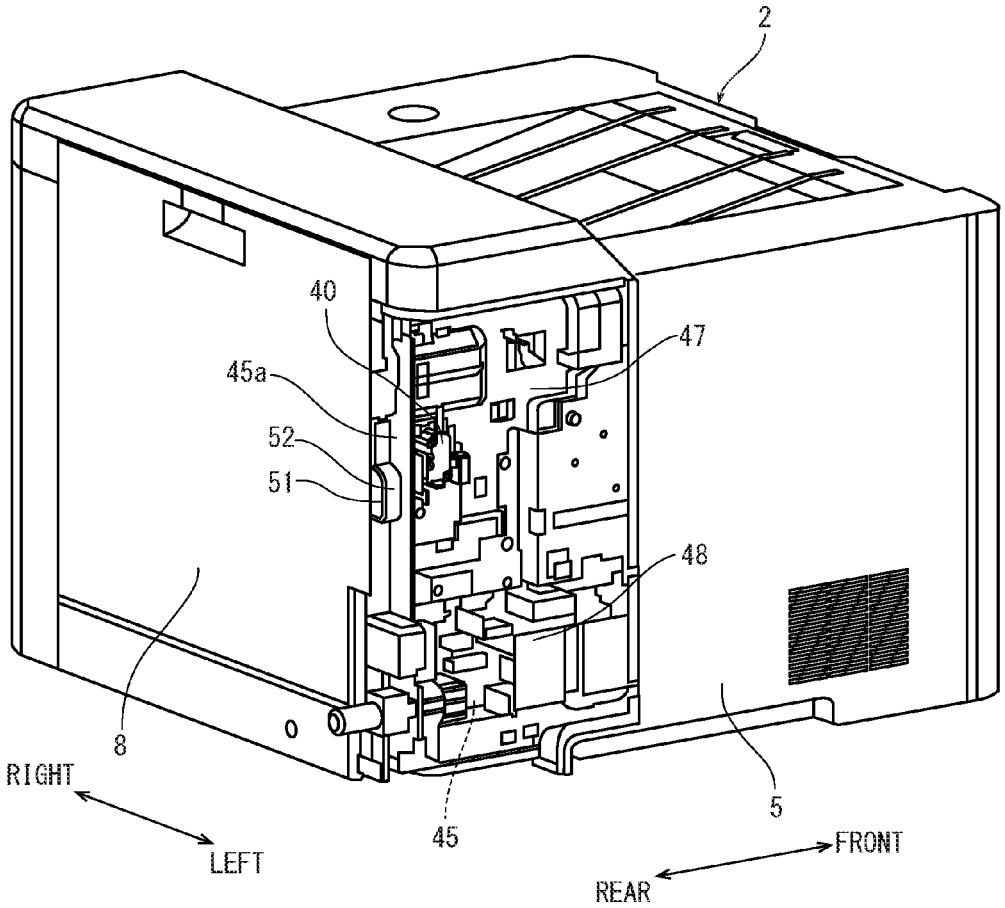
FIG. 4 is a perspective view showing the apparatus main body with a left side cover removed, viewed from the rear side, in the color printer according to one embodiment of the present disclosure.
Figure 5:
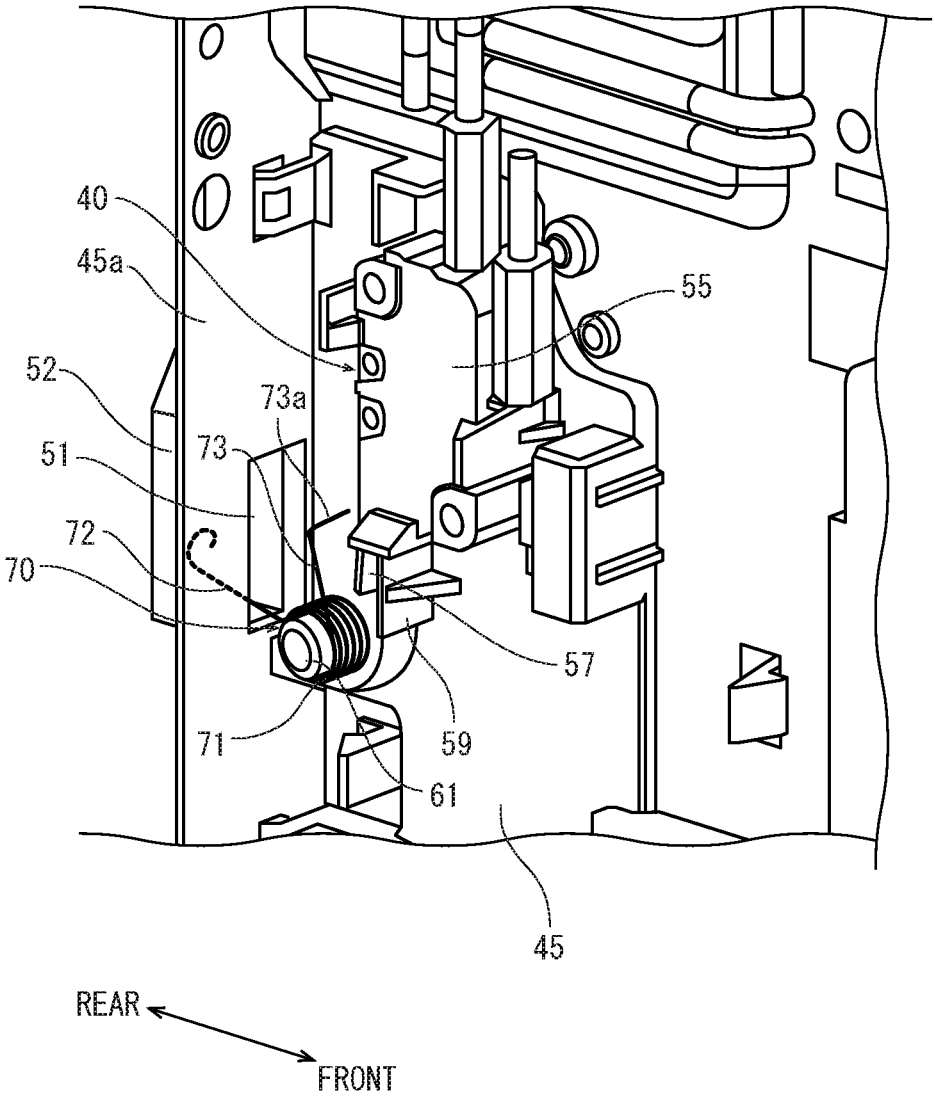
FIG. 5 is a perspective view showing an interlock switch in OFF state and its peripheral portions, in the color printer according to one embodiment of the present disclosure.
Figure 6:
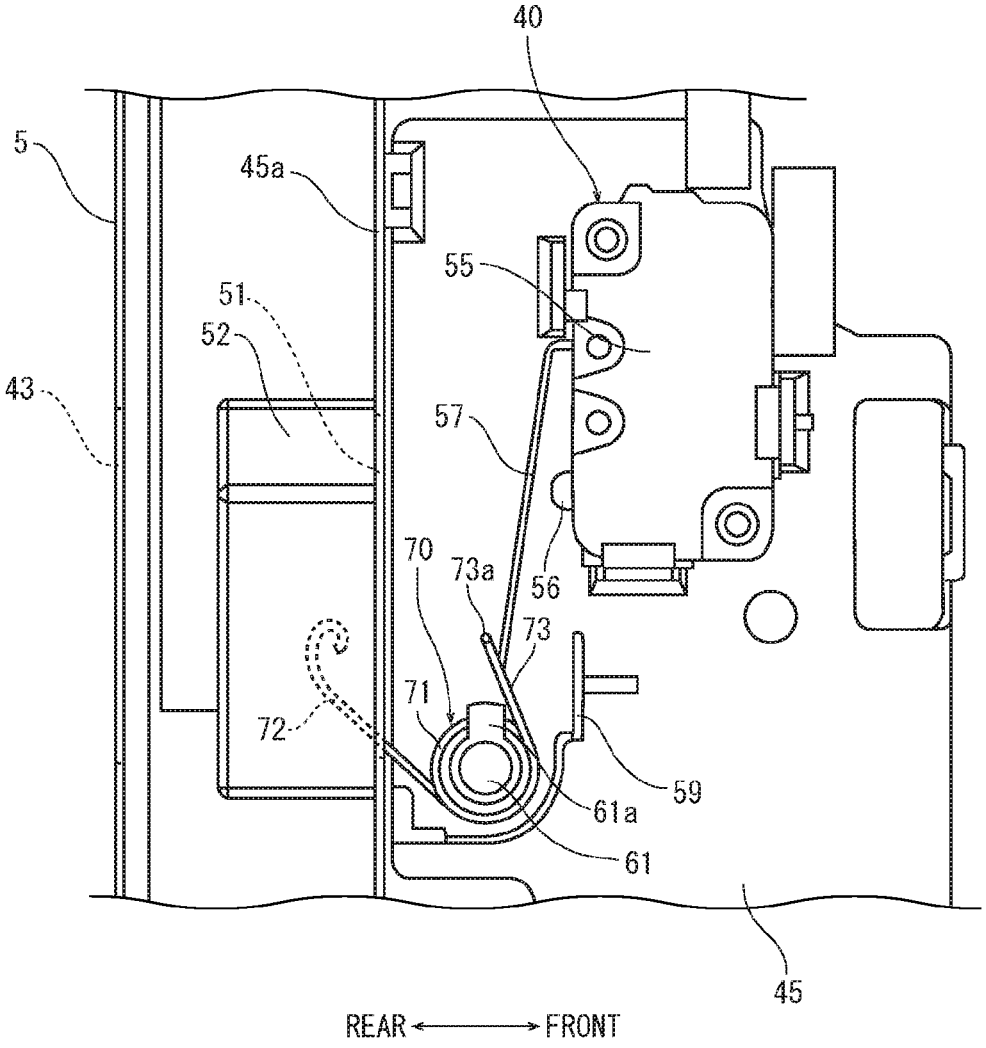
FIG. 6 is a front view showing the interlock switch in the OFF state and the peripheral portions, in the color printer according to one embodiment of the present disclosure.
Figure 7:
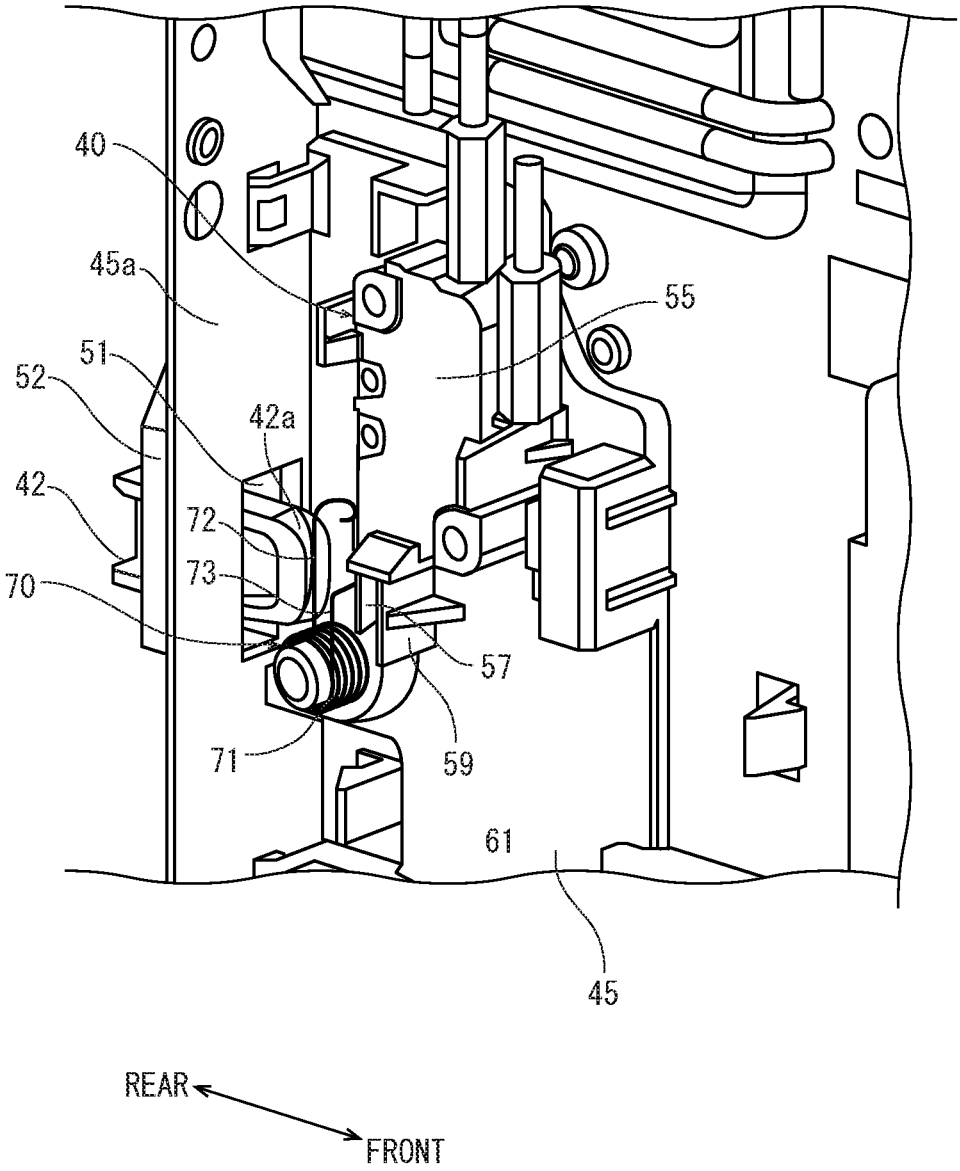
FIG. 7 is a perspective view showing the interlock switch in ON state and the peripheral portions, in the color printer according to one embodiment of the present disclosure.
Figure 8:
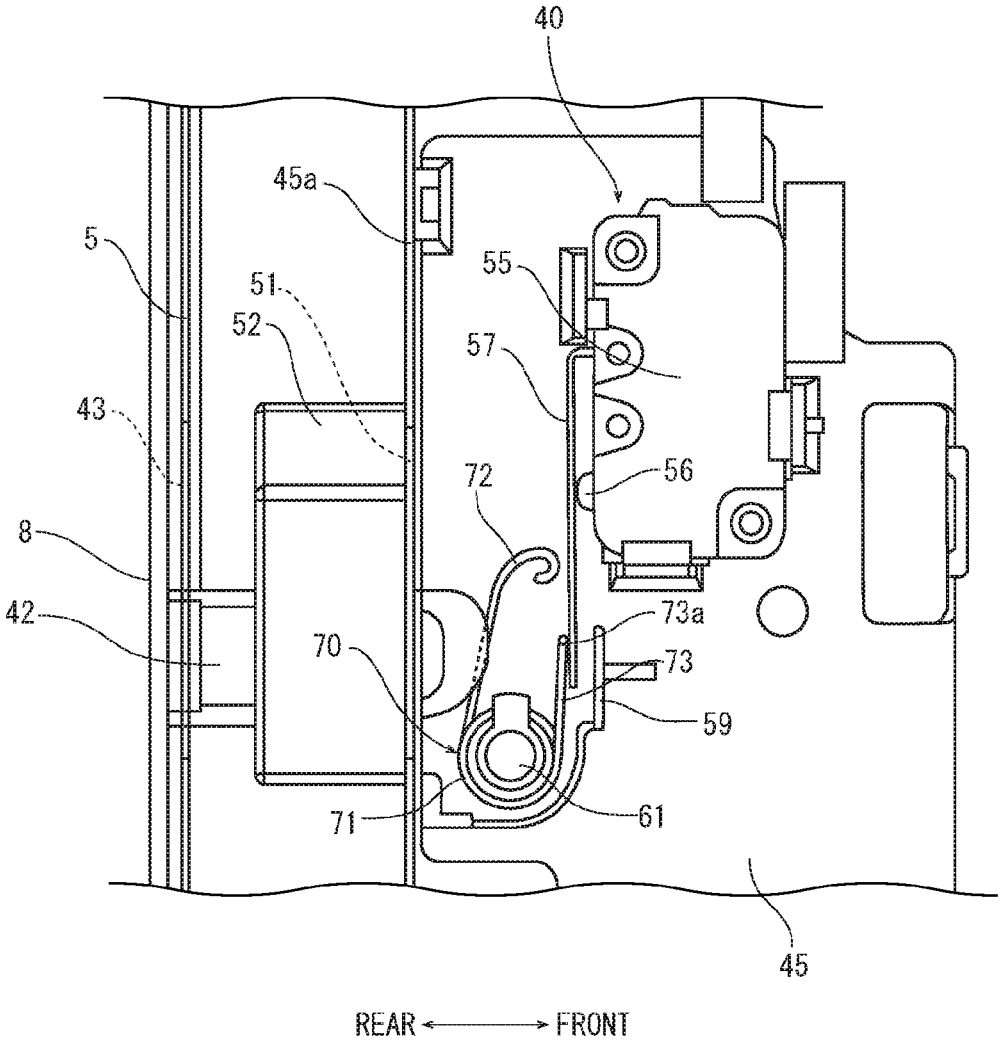
FIG. 8 is a front view showing the interlock switch in the ON state and the peripheral portions, in the color printer according to one embodiment of the present disclosure.

Next, the rear cover 8 and the interlock switch 40 will be described with reference to FIG. 3 to FIG. 8. FIG. 3 is a perspective view showing the color printer with the rear cover opened, viewed from the rear side and FIG. 4 is a perspective view showing the color printer with the left side cover removed, viewed from the rear side. FIG. 5 to FIG. 8 are views showing the interlock switch and its peripheral portions. FIG. 5 and FIG. 6 are respectively a perspective view and a front view showing the rear cover in the opening state and FIG. 7 and FIG. 8 are respectively a perspective view and a front view showing the rear cover in the closing state.

As shown in FIG. 3, the rear cover 8 is formed with a projection 42. The projection 42 protrudes forward from a center portion in the vertical direction of a left side edge portion of the inner face of the rear cover 8. A tip end face of the projection 42 curves in an arc shape in a side view. In the tip face of the projection 42, a vertical groove 42*a* is formed (refer to FIG. 7). The left side cover 5 is formed with a passing port 43 through which the projection 42 is passed when the rear cover 8 is closed.

As shown in FIG. 4, inside of the left side cover 5, a base member 45 is provided. Along an outer periphery of the base member 45, a side edge portion bent outward is formed. In a recess surrounded by the side edge portion, a main control substrate 47, a power supply substrate 48 and a shield member (not shown) are supported on the base member 45. The main control substrate 47 controls the image forming unit and the others. The power supply substrate 48 is electrically connected to an exterior power source and supplies the power to the main control substrate 47. The shield member covers outsides of the main control substrate 47 and the power supply substrate 48 to shield them electrically.

In the rear side edge portion 45*a* bent outward along the rear edge of the base member 45, an inner passing port 51 is formed so as to align with the passing port 43 formed in the left side cover 5. Around the inner passing port 51, a guide tube 52 protrudes rearward.

As shown in FIG. 5 and FIG. 6, the interlock switch 40 is supported on the base member 45 above the inner passing port 51 by hooks. The interlock switch 40 has a rectangular parallelepiped shaped main body part 55, a switching part 56 protruding from a side face of the main body part 55 and an operating lever 57 which presses and releases the switching part 56. The main body part 55 is supported on the base member 45 with the switching part 56 directed rearward so that the switching part 56 is pressed and released from the pressing in the front and rear directions. The switching part 56 is pushed into the main body part 55 by being pressed with predetermined load and is returned into an original posture by being released from the pressing. When the switching part 56 is pressed, the interlock switch 40 is switched into ON state to detect that the rear cover 8 is in the closing state. When the switching part 56 is released from the pressing to return into the original posture automatically, the interlock switch 40 is switched into OFF state to detect that the rear cover 8 is in the opening state and then to interrupt the power supply from the power supply substrate 48 to the conductive members via the main control substrate 47.

The operating lever 57 is supported to the side face of the main body part 55 in a cantilever manner above the switching part 56. In a normal posture, the operating lever 57 is suspended in a lower oblique direction beyond the main body part 55. When being pressed, the operating lever 57 is turned in the counterclockwise direction in FIG. 6 into a pressing position to press the switching part 56. When being released from the pressing, the operating lever 57 is elastically returned into the normal posture (a releasing position) to release the switching part 56. With the elastic retuning of the operating lever 57, the switching part 56 is returned into the original posture.

On the base member 45, a restricting part 59 in a plate shape is formed along the vertical direction below the interlock switch 40. The restricting part 59 is configured to restrict the pressing of the operating lever 57 over the switching part 56.

On the base member 45, a boss 61 is formed inside of the inner passing port 51. From a tip end of the boss 61, a slip-off preventing piece 61*a* protrudes radially. Around the boss 61, a torsion coil spring 70 is fitted. The torsion coil spring 70 is an elastic member interposed between the rear cover 8 and the interlock switch 40.

The torsion coil spring 70 has a coil part 71, a first arm part 72 and a second arm part 73. The coil part 71 is formed by winding a wire in a spiral shape. The first arm part 72 is formed by extending the wire from one end of the coil part 71. The second arm part 73 is formed by extending the wire from the other end of the coil part 71. A tip portion of the first arm part 72 is wound spirally in the same winding direction as the coil part 71. At a tip portion of the second arm part 73, a bent portion 73*a* bent along a coil axis of the coil part 71 is formed. The first arm part 72 has a length longer than a length of the second arm part 73.

The coil part 71 is supported by the boss 61 so as to be turnable with the slipping off from the boss 61 prevented by the slip-off preventing piece 61*a*. The first arm part 72 is engaged with a lower edge of the inner passing port 51 formed in the rear side edge portion 45*a* of the base member 45. Then, the torsion coil spring 70 is grounded into the base member 45. The second arm part 73 directs in a rear upper direction and the bent portion 73*a* is separated rearward from the operating lever 57 of the interlock switch 40.

In the color printer having the above configuration, a turning of the rear cover 8 will be described with reference to FIG. 5 to FIG. 8.

When the rear cover 8 is turned into the opening state where the opening 2*a* is opened, as shown in FIG. 5 and FIG. 6, in the torsion coil spring 70, the first arm part 72 is engaged with the lower edge of the inner passing port 51 formed in the rear side edge portion 45*a* of the base member 45 and the second arm part 73 is separated rearward from the operating lever 57 of the interlock switch 40.

When the rear cover 8 is turned into the closing state where the opening 2*a* is closed, the projection 42 formed on the inner face of the rear cover 8 passes the passing port 43 of the left side cover 5 and enters the inner passing port 51 through the guide tube 52 of the rear side edge portion 45*a* of the base member 45. Then, when the groove 42*a* of the projection 42 abuts against the first arm part 72, the coil part 71 of the torsion coil spring 70 is turned in the clockwise direction in FIG. 5 and FIG. 6 around the boss 61.

Then, as shown in FIG. 7 and FIG. 8, the second arm part 73 abuts against the operating lever 57 and presses the operating lever 57. When pressed, the operating lever 57 presses the switching part 56 so that the interlock switch 40 is switched into the ON state. During the turning of the torsion coil spring 70, since the curved tip portion of the first arm part 72 is slide along the groove 42*a* of the projection 42, it becomes possible to turn the torsion coil spring 70 smoothly so as not to deflect horizontally.

In addition, if the rear cover 8 is further turned after the switching part 56 is pressed, the first arm part 72 is pressed by the projection 42 and approaches the second arm part 73. In other words, the torsion coil spring 70 is elastically deformed such that the first arm part 72 and the second arm part 73 approach each other. Then, a turning distance of the rear cover 8, that is, a turning distance of the projection 42 after the switching part 56 is pressed is absorbed by the elastic deformation of the torsion coil spring 70 so that the switching part 56 is not applied with large load through the operating lever 57. In addition, when the rear cover 8 abuts against the left side cover 5, the turning of the rear cover 8 is prevented so that the first arm part 72 may not be excessively pressed by the projection 42. Furthermore, since the tuning of the operating lever 57 is restricted by the restricting part 59, the interlock switch 40 can be protected more surely.

When the rear cover 8 is turned into the opening state where the opening 2*a* is opened, the projection 42 is separated from the first arm part 72 of the torsion coil spring 70 and then the operating lever 57 is elastically returned into the normal posture. Then, the switching part 56 is released from the pressing and the interlock switch 40 is switched into the OFF state. By the elastic returning of the operating lever 57, the second arm part 73 is biased to turn the coil part 71 in the counterclockwise direction in FIG. 7 and FIG. 8 around the boss 61. In addition, since the first arm part 72 has the length longer than the length of the second arm part 73, the coil part 71 easily turns in a direction of the first arm part 72 by the weight of the first arm part 72, that is, in the counterclockwise direction. Then, the first arm part 72 is automatically engaged with the lower edge of the inner passing port 51 (refer to FIG. 5 and FIG. 6).

As described above, in the color printer 1 according to the present disclosure, the torsion coil spring 70 makes it possible to activate the interlock switch 40 surely with the tuning of the rear cover 8 into the opening state and the closing state. Accordingly, the erroneous detecting of the interlock switch 40 can be prevented. In addition, a variation in turning distance of the projection 42 caused by the large variation in dimension precision of the rear cover 8 is absorbed by the elastic deformation of the torsion coil spring 70. Accordingly, the interlock switch 40 may not be damaged by being applied with excessive load.

In a state where the rear cover 8 is turned into the opening state where the opening 2*a* is opened, the torsion coil spring 70 is automatically supported such that the first arm part 72 is engaged with the lower edge of the inner passing port 51 and the second arm part 73 is separated from the operating lever 57. Under the state, when the rear cover 8 is turned into the closing state where the opening 2*a* is closed, the projection 42 abut against the first arm part 72 first. At this time, if a user who turns the rear cover 8 may be electrically charged, when the user brings his finger closer to the inner passing port 51, the static charge of the user is grounded into the base member 45 through the first arm part 72 and the coil part 71. Accordingly, the static charge is prevented from flowing into the interlock switch 40 so that the interlock switch 40 can be protected against the static charge.

In the embodiment, the torsion coil spring 70 is used as the elastic member; a plate spring or the like may be used. However, the torsion coil spring 70 is preferable because of simple structure and easy assembling.

The embodiment shows a case where the rear cover 8 is turned to open and close the opening 2*a* of the apparatus main body 2*a*. However, the embodiment can be applied to a cover member which is slid to open and close the opening 2*a* of the apparatus main body 2*a*.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a cover member supported so as to open and close an opening formed in an apparatus main body, an opening/closing detecting device configured to be switched into OFF state to detect that the cover member is in opening state where the opening is opened and into ON state to detect that the cover member is in closing state where the opening is closed, and an elastic member interposed between the opening/closing detecting device and the cover member, wherein the elastic member is configured to be deformed when the cover member closes the opening and then to switch the opening/closing detecting device from the OFF state into the ON state, wherein the elastic member has electric conductivity and is supported so as to be separated from the opening/closing detecting device and be grounded into the apparatus main body when the cover member is in the opening state.

2. The image forming apparatus according to claim 1, wherein the opening/closing detecting device has a switching part configured to be switched into the ON state and into the OFF state by being pressed and released from the pressing and an operating lever configured to be turnable between a pressing position to press the switching part and a releasing position to release the pressing of the switching part and to be elastically returned into the releasing position, wherein when the cover member closes the opening, the operating lever is pressed by the cover member through the elastic member to be turned into the pressing position and then presses the switching part so that the switching part is switched from the OFF state into the ON state.

3. The image forming apparatus according to claim 2, comprising a restricting part which restricts a turning range of the operating lever to the pressing position.

4. An image forming apparatus comprising:

a cover member supported so as to open and close an opening formed in an apparatus main body, an opening/closing detecting device configured to be switched into OFF state to detect that the cover member is in opening state where the opening is opened and into ON state to detect that the cover member is in closing state where the opening is closed, and an elastic member interposed between the opening/closing detecting device and the cover member, wherein the elastic member is configured to be deformed when the cover member closes the opening and then to switch the opening/closing detecting device from the OFF state into the ON state, wherein the elastic member is a torsion coil spring and, the torsion coil spring has a coil part supported to the apparatus main body so as to be turnable, a first arm part extending from one end of the coil part and facing the cover member, and a second arm part extending from the other end of the coil spring and facing the opening/closing device, wherein when the cover member closes the opening, the first arm part is abutted on the cover member to turn the coil part and then the second arm part switches the opening/closing detecting device from the OFF state into the ON state while the torsion coil spring is elastically deformed.

5. The image forming apparatus according to claim 4, wherein the first arm part has a length longer than a length of the second arm part.

6. The image forming apparatus according to claim 4, wherein when the cover member is in the opening state, the first arm part is engaged with a passing port formed in the apparatus main body and the second arm part is separated from the opening/closing detecting device.

* * * * *